US005397033A

United States Patent [19]

Blomquist

[11] Patent Number: 5,397,033

[45] Date of Patent: Mar. 14, 1995

[54] DEVICE FOR THE CONTROLLED DISPENSING OF RODENTICIDES

[75] Inventor: Eric N. Blomquist, Phoenix, Ariz.

[73] Assignee: Farnam Companies, Phoenix, Ariz.

[21] Appl. No.: 165,656

[22] Filed: Dec. 13, 1993

[51] Int. Cl.[6] ..... B67D 5/06

[52] U.S. Cl. ..... 222/185; 222/457; 43/131; 119/53

[58] Field of Search ..... 222/153, 185, 457, 519, 222/549, 562; 43/121, 131; 119/53, 53.5, 77

[56] References Cited

U.S. PATENT DOCUMENTS 2,309,997 2/1943 Thieman ..... 222/457 X
2,515,698 7/1950 Cosby ..... 119/53
3,124,277 3/1964 Helland ..... 222/457 X
4,746,033 5/1988 Morellini ..... 43/131 X
4,840,143 6/1989 Simon ..... 43/131 X

*Primary Examiner*—Gregory L. Huson
*Attorney, Agent, or Firm*—Joseph H. Roediger

[57] ABSTRACT

A dispenser for stored rodenticide pellets wherein the pellets are contained within a cylindrical cap which is maintained in contact with a base. The base includes an inclined skirt bounded by an external flange. The cap is raised on a central post to enable the pellets to move down the inclined base and rest adjacent the flange. The pellets are then available to rodents while being retained on the dispenser by the flange. The cap can be lowered to close the dispenser to deny access to remaining stored pellets.

11 Claims, 1 Drawing Sheet

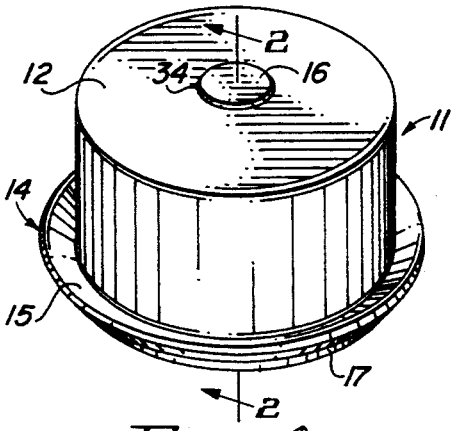
FIG. 1
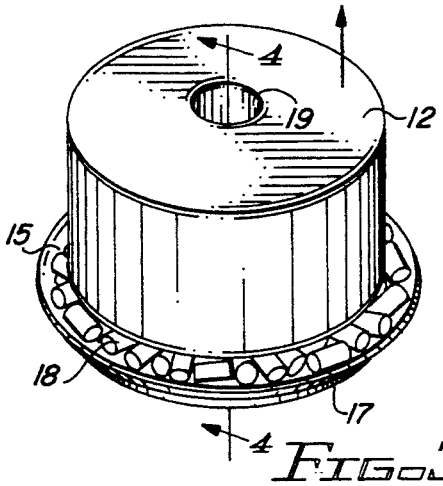
FIG. 3
FIG. 2
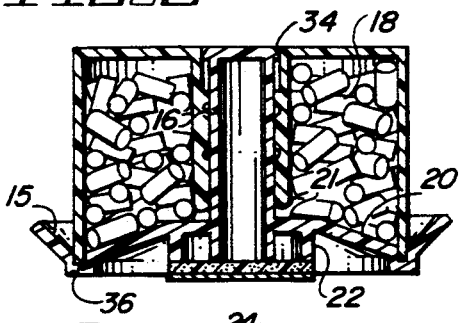
FIG. 4
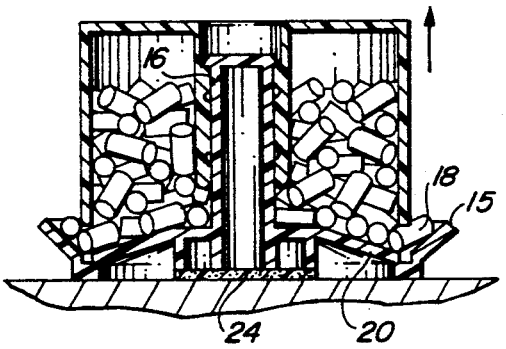
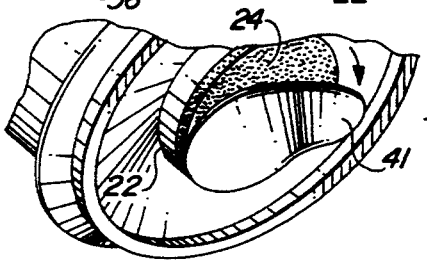
FIG. 6
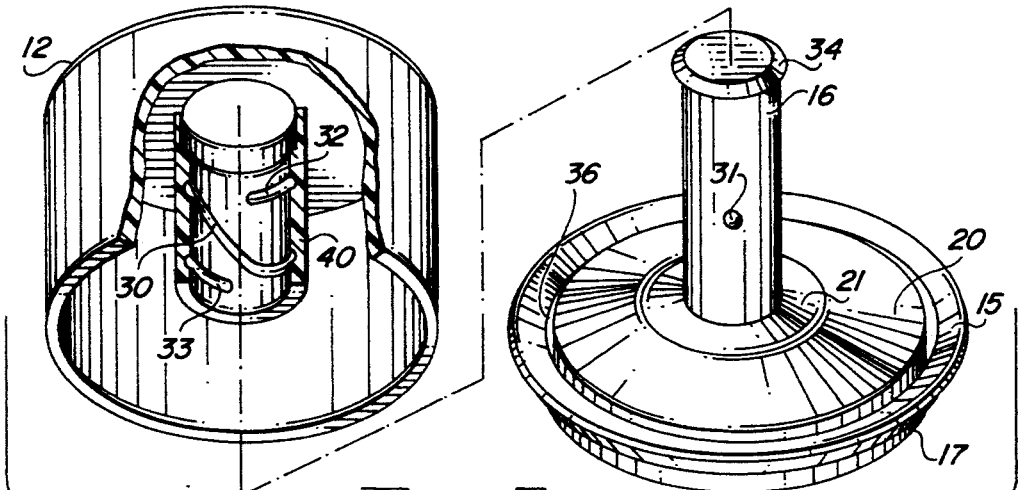
FIG. 5

DEVICE FOR THE CONTROLLED DISPENSING OF RODENTICIDES

BACKGROUND OF THE INVENTION

This invention relates to a device for the controlled dispensing of rodenticicles and, in particular, to a dispenser wherein a pelletized rodenticicle need not be handled by the user.

The ever-increasing awareness of the effects of toxic substances, both on individuals and on the surrounding environment, have created a demand for products using toxic materials in a controlled and confined manner. In the past, toxic substances in granular or pelletized form were scattered on the ground or placed on open containers to provide a measure of control of rats, mice and other vermin. The practice of scattering toxic substances is no longer acceptable and the use of open containers wherein the toxic substances might be available to small animals and children are in disfavor. Furthermore, the use of toxic substances in urban and suburban areas wherein the population density is relatively large is a matter of great concern.

The desire to control distribution of toxic substances has led to poison bait stations such as shown in U.S. Pat. No. 2,977,711 wherein a bait dish is provided with a separate cover containing apertures sized to exclude small animals. The use of a feeding dish requires that the users transfer the toxic substance from a larger container to the feeding dish thereby exposing both themselves and the environment to the substance. In addition, the placement of the cover is a temporary matter for the cover can be dislodged exposing the open dish to other animals. A combination dish and cover structure is shown in U.S. Pat. No. 2,710,485 wherein tile cover is attached to tile base structure. Apertures define passageways and control access with the toxic material being made available through inner openings. While the dispenser is still loaded by the user, the problem of dislodging the cover is eliminated. However, the handling and movement of this device creates an opportunity for spillage since the toxic substance is not fully confined during movement. A preloaded and sealed dispensing device is shown in U.S. Pat. No. 4,211,028 wherein the poison is contained in a chamber having a wall made of a consumable substance having a taste or odor attractive to rodents. The problems associated with the transfer of toxic substances to the device and the possibility of spillage occurring during initial placement of the device are eliminated by this particular structure. However, once the rodent has chewed through the containing wall, the poison tumbles out and is available to the rodent and to other animals. Furthermore, the poison bait is exposed to moisture in this type of device and to the marking activities of rodents which seine to discourage use by other rodents.

A different approach is taken in the dispensing apparatus shown in U.S. Pat. No. 4,746,033 wherein a vertical pipe serves as a reservoir for granular or pelletized toxic material. The device is augured into the ground with a container proximate to the bottom of the tube contacting the ground to serve as a catchment for contained material. A protective cover is slidably mounted on the tube and extends outwardly of the containers so that access can be denied to larger animals and it can be covered during nonoperating periods. The tube communicates with the lower container through one or more apertures and the granular material flows downwardly and outwardly into the container. The device is not preloaded so that the user must fill the tube from a larger storage container. The device is intended to be used in agricultural fields which enables it to be inserted into the ground.

Accordingly, the present invention is directed to the provision of a device for the controlled dispensing of toxic substances wherein the device can be preloaded prior to shipment to the user. In addition, the device is constructed to enable it to be readily opened by the user without spillage of the contents. The opening exposes the toxic bait about the peripheral region of the device to provide a 360° access to the bait. In addition, the present invention limits the availability of the toxic substance to feeding vermin by controlled dispensing about the peripheral region thereby reducing the likelihood of materials flowing outwardly of the device. Thus, the user need not handle the toxic substance and the opportunity for unintentionally scattering the material on the ground, either during use or during movement to another site, is essentially eliminated.

The subject invention is formed of two parts each of which is well suited for injection molding to provide a low cost of manufacture. The relative movement between the two parts controls the amount of material available as well as establishing the size of the opening through which the vermin may feed. The opening extends around the device to provide access to the bait therein.

SUMMARY OF THE INVENTION

The present invention is directed to apparatus for the controlled dispensing of stored toxic granular materials, typically a rodenticide pellet, which comprises a two part assembly including base structure and a cap movably mounted thereon. The base structure includes an inclined skirt upon which the pellets are supported, and a peripheral flange joined to the skirt with the flange extending upwardly and outwardly from the skirt. A post is centrally mounted on the base structure to provide a guide for vertical movement of the cap.

The cap is dimensioned to contact the juncture of the skirt and flange when the apparatus is in the closed position and the toxic material is contained therein. The apparatus also includes means for limiting the vertical movement of the cap and defining the open position. By limiting the movement of the cap away from the skirt and flange juncture, the movement of pellets contained within the cap along the skirt to rest against the flange is controlled. Pellets adjacent the flange are accessible to rodents when the cap is in an open position. However, by limiting the vertical movement of the cap, the pellets do not overflow the flange and are contained within the device.

In a preferred embodiment, the flange forms an oblique angle with the skirt. The skirt has a downward slope to assist in the movement of the toxic material from under the cap toward the flange. The flange serves as a stop for the material and it is those granules or pellets proximate to the flange that are available to the feeding rodent. The cap is threadedly engaged on the post and the limit means is located thereon to provide a stop to relative movement between cap and base structure.

In the manufacture of the present invention, the parts are well suited for injection molding to provide a low cost of manufacture. The assembly steps include the placement of the cap in an inverted position followed by the insertion of the granules or pellets into the cap. While in this inverted position, the base structure is then threaded downwardly thereon so that the juncture between skirt and flange of the base structure contact the bottom edge of the cap. Normally, a groove is provided at the juncture to receive and firmly seat the cap therein. The device is then ready for packaging and shipment. The provision of a low cost, preloaded rodenticide dispenser is a primary objective of the present invention.

Further features and advantages of the invention will become more readily apparent from the following detailed description thereof when taken in conjunction with the accompanying drawings.

BRIEF DESCRIPTION OF THE DRAWINGS

FIG. 1 is a view in perspective of one embodiment of the invention in a closed position.

FIG. 2 is a cross sectional view taken along line 2—2 of FIG. 1.

FIG. 3 is a view in perspective of the embodiment of FIG. 1 in an open position.

FIG. 4 is a cross sectional view taken along line 4—4 of FIG. 3.

FIG. 5 is an exploded view of the embodiment of FIG. 1 with the cap in partial section.

FIG. 6 is a partial view in perspective of the bottom of the embodiment of FIG. 1.

DESCRIPTION OF THE PREFERRED EMBODIMENT

Referring now to FIG. 1, the present invention is shown in preferred form which includes a cap 12 fitted in contact with base structure 14. The cap is dimensioned to fit against the base at the bottom of flange 15. A central post 16 is provided with a circumferential sealing flange 34 which contacts the adjacent portion of the cap. In FIG. 1, the device is shown in the closed position with the toxic material in pelletized form contained within the device. While the embodiment described contains pellets, it should be noted that other shapes or forms of solid toxicants can be used if desired.

The cross sectional view of FIG. 2 shows the device filled with rodenticide pellets 18. The side wall of cap 12 extends downwardly to the base of flange 15 and rests in circumferential groove 36. The groove provides a seal to prevent any of the toxic material contained in the device from migrating outwardly from the base structure during shipment and handling. The rodenticide pellets are friable and may self-abrade during movement thereby creating a powder which tends to fall to the bottom of the device. Since the contained material is toxic, any leakage of material is highly undesirable even when the device is packaged. The center post 36 is provided with a sealing flange 34 which inhibits loss of material through the central opening of cap 12. Thus, the pellets and any generated powder are confined until the device is placed in operation.

As shown in FIG. 2, the cap 12 is threaded onto post 16 for vertical movement in relation to the base. The structure of base 14 is seen more clearly in FIG. 5 wherein the central post 16 is shown with a guide 31 projecting from its side surface. The post extends from a central platform 21. The platform is horizontal and is connected to a skirt 20 which extends outwardly and downwardly therefore terminating in circumferential groove 36. As mentioned previously, groove 36 receives the bottom edge of the cap 12 when the device is in the closed position. The guide 31 on post 16 travels within the thread 30 formed in the wall 40 of cap 12. Thread 30 is terminated at the upper end by limit 32 and at its lower end by limit 33. These limits permit the cap to be rotated and moved relative to the base structure 14 between defined positions. The cylindrical wall 40 depends from the top of the cap 12 and defines the top opening 19 into which the post 16 and sealing flange 34 extend when the device is in the closed position of FIGS. 1 and 2.

The opening of the embodiment of FIG. 1 to provide access to the rodenticide pellets contained therein is shown in FIGS. 3 and 4. In order to open the device, cap 12 is rotated in relation to the base structure 14 thereby causing the guide to move along the threads toward the lower limit 33 in wall 40. As the cap rises above the base structure, a circumferential opening is provided therebetween to establish a 360° feeding opportunity for rodents. The pelletized material 18 contained in the cap is fed by the force of gravity downwardly and outwardly along the inclined skirt 20. The outermost pellets rest against the flange 15 and none of the bait contacts the ground. The vermin can feed on the exposed material without entering the device thereby reducing the opportunity for contamination or marking of the bait by the vermin. As material is consumed, the pellets continue to move downwardly and outwardly to continuously provide a toxicant supply until the material in the cap is consumed. The limiting of the direction of travel of the cap in the direction of the arrow shown in FIGS. 3 and 4 prevents the pellets from flowing out of the trough formed by the flange 15 and the adjacent skirt 20. In the preferred embodiment, the limit of vertical movement of cap 12 is set to prevent the cap from moving more than the thickness of the pellet above the edge of flange 15. As a result, the onward flow of pellets is prevented. In use, the device is mounted on the base surface 25 and removably affixed by an adhesive pad 24 affixed to the bottom of the support member 22. The adhesive pad 24 is provided with a transfer coating 41 as shown in FIG. 6.

During assembly, the molded cap is inverted and the pellets are added. The cap and base structure are made of thin walled flexible plastic so that the post 16 and flange 34 combination can be urged through the cylindrical wall 40 to the point where the guide 31 enters the thread 30. Next, the base structure is rotated until the sealing flange 34 emerges at the top opening 19. At this point, the device is sealed since the guide 31 rotates in thread 30 until the bottom edge of the cap 12 resides in the groove 36. The center post 16 and the central platform 21 are reinforced by the circular support member 22 extending downwardly from the platform. The central platform 21 is orthogonal to the post 16 and the inclined skirt 20 extends to terminate at groove 36. The flange 15 extends outwardly from the skirt, preferably at an angle greater than 90°, to serve as a retaining wall for the pellets. By limiting the vertical movement of the cap to a position which is less than the thickness of the stored granular or pelletized material above the edge of the flange, spillage is avoided during normal usage. The rotation of the cap in the reverse direction allows the device to be closed if vermin control at this location is to be suspended. The device can be transported to another location without fear of spillage of the contents of the cap. Since residual material is likely to reside outside the cap, care must be taken to prevent it from being spilled during placement at another location.

While the above description has referred to a specific embodiment of the invention, it is to be noted that variations and modifications may be made therein without departing from the scope of the invention as claimed.

I claim:

1. Apparatus for the controlled dispensing of stored rodenticide pellets which comprises:

a) a base structure having an upper surface for facilitating the distribution of stored pellets, said upper surface including a downwardly inclined skirt and a peripheral flange joined to the skirt, said flange extending upwardly from the skirt;

b) a post centrally mounted on the base structure;

c) a cap for confining tile pellets, said cap being mounted oil the post for vertical movement between open and closed positions, said cap being dimensioned to contact the juncture of the skirt and flange when in the closed position: and d) means for limiting vertical movement of the cap and defining the open position of the cap to thereby control the movement of pellets on the skirt, the pellets adjacent the flange being accessible to rodents when the cap is in an open position.

2. The invention in accordance with claim 1 wherein said flange extends outwardly and upwardly from the skirt.

3. The invention in accordance with claim 2 wherein said flange forms an oblique angle with the skirt.

4. The invention in accordance with claim 3 wherein said upper surface has a horizontal central platform from which the skirt depends.

5. The invention in accordance with claim 4 wherein said post is mounted on the central platform.

6. The invention in accordance with claim 5 wherein said cap threadedly engages said post for vertical movement therealong.

7. The invention in accordance with claim 6 wherein said base structure and said cap are cylindrical.

8. The invention in accordance with claim 7 further comprising a support member extending downward from said central platform for engagement with a support surface.

9. The invention in accordance with claim 8 further comprising adhesive means affixed to said support member.

10. The invention in accordance with claim 9 wherein said cap includes a cylindrical tube dimensioned to surround and engage the post.

11. The invention in accordance with claim 10 wherein said post includes a sealing flange for engagement with the cap when said cap is in the closed position.

* * * * *